US006925654B2

(12) United States Patent
De Silva

(10) Patent No.: US 6,925,654 B2
(45) Date of Patent: Aug. 9, 2005

(54) SAFETY SIGNAL JACKET FOR RIDERS OF NON-ENCLOSED VEHICLES

(76) Inventor: Shelton Gamini De Silva, 2770 Mt. Seymour Parkway, North Vancouver (CA), V7H 1E9

( * ) Notice: Subject to any disclaimer, the term of this patent is extended or adjusted under 35 U.S.C. 154(b) by 125 days.

(21) Appl. No.: 10/486,931

(22) PCT Filed: Aug. 28, 2001

(86) PCT No.: PCT/CA01/01198

§ 371 (c)(1),
(2), (4) Date: Feb. 11, 2004

(87) PCT Pub. No.: WO03/015551

PCT Pub. Date: Feb. 27, 2003

(65) Prior Publication Data

US 2004/0184262 A1 Sep. 23, 2004

(30) Foreign Application Priority Data

Aug. 13, 2001 (CA) ..... 2356589

(51) Int. Cl.[7] ..... A41D 1/02
(52) U.S. Cl. ..... 2/108; 362/108
(58) Field of Search ..... 2/102, 69, 93, 2/94, 108, 85; 362/103, 108, 84, 189

(56) References Cited

U.S. PATENT DOCUMENTS

| | | | | |
|---|---|---|---|---|
| 4,328,533 A | | 5/1982 | Paredes | |
| 4,602,191 A | * | 7/1986 | Davila | 315/76 |
| 4,709,307 A | * | 11/1987 | Branom | 362/103 |
| 4,839,777 A | * | 6/1989 | Janko et al. | 362/108 |
| 5,070,436 A | | 12/1991 | Alexander et al. | |
| 5,249,106 A | * | 9/1993 | Barnes et al. | 362/108 |

FOREIGN PATENT DOCUMENTS

| | | |
|---|---|---|
| CA | 02379247 | 2/2003 |
| CA | 2423880 | 2/2003 |
| DE | 20013002 | 12/2000 |
| EP | 0115478 | 8/1984 |
| EP | 648436 | 4/1995 |
| FR | 2280156 | 2/1976 |
| WO | PCT-CA03-00772 | 6/2003 |

* cited by examiner

*Primary Examiner*—Tejash Patel
(74) *Attorney, Agent, or Firm*—Omori & Yaguchi USA, LLC

(57) ABSTRACT

A safety signal jacket includes the garment shaped strap jacket, which can be worn over the existing cloths of a rider of non-enclosed vehicles, means bicycles, roller blades, skate boards, skies, jet skies, water skies, snowmobiles etc., comprises of signal apparatus (27, 34) and horn apparatus (40) which alert and forewarn the other vehicles, other non-enclosed vehicles and pedestrian on the road and its' vicinity. Further, said signal light apparatus (27, 34) electrically communicates with switch panel assemblies (37) and power source in battery assembly, and other among devices through plurality of wires, to activate said signal lights (27, 34) and illuminate and flash in an intermittent manner and activate, illuminate and remain on, creating a visible signal to indicate the turning signal, moving signal slowing signal and stopping signal, as well as the horn assembly (40) for sound modulation for warning signal. The safety signal jacket also provides cost-efficiency that by owing one safety jacket the wearer may use the same for various activities without any modification to the components of said jacket to the components of said jacket.

32 Claims, 7 Drawing Sheets

SAFETY SIGNAL JACKET FOR RIDERS OF NON-ENCLOSED VEHICLES

BACKGROUND OF THE INVENTION

1. Field of the Invention

The present invention relates to a signal strap jacket which comprises of signal lights apparatus and a horn apparatus, especially for people riding non-enclosed vehicles means bicycles, roller blades, skate boards, skies, jet skies, water skies, snowmobiles etc., and more particularly, but not by way of limitation, said apparatus to be activated by the way of electrical communication, and displaying the signal lights apparatus indicating the riders approach, direction of turning, slowing, stopping and moving, and also the sound modulation of the horn apparatus.

2. Description of the Related Art

In accordance with the prior art, the aforementioned purpose has been accomplished by providing signal light apparatus and horn apparatus which is attached to the non-enclosed vehicles, especially for bicycles, which is attached to the non-enclosed vehicles means, the signal light apparatus is installed at the rear, around the seat of the bicycle that may not clearly be visible to other drivers and pedestrians on the road and its' vicinity. However the majority of bicycles are not equipped with any signal lights, and these riders tend to use hand signals to alert and forewarn other vehicles and pedestrians on the road, also some riders have a tendency of making sudden moves without any warnings. Moreover, bicycles with signal lights generally comprise of only rear signals, without any front signal lights, this is extremely dangerous, since other oncoming vehicles may not notice the approach of said non-enclosed vehicles, and may cause major accidents. There are no signal light systems found for riders using other non-enclosed vehicles means, roller blades, skate boards, skies etc., normally such riders proceed at a high speed depending entirely on visual judgment. Some riders scream and shout to alert and forewarn their approach of direction, others just pass each other without any indication of their approach of direction. This is because these riders are not equipped with a proper signal light system unlike in other automobiles. Often, however, due to the confusion, lack of hearing and lack of visibility etc., thousands of accidents occur everyday, some are serious enough to damage vital parts of the body or loss of life of such riders as well as others.

This problem is well known in the art and no satisfactory solution has been found. Today, streets, parks and other public areas are becoming more and more accessible and used by riders who ride such non-enclosed vehicles, increasing the number of accidents everyday.

There are number of similar lighted jackets that have been proposed in prior art, these jackets have been especially made as life jackets for flotation purposes. However, the present invention has been invented substantially departing from prior concepts and designs, that provides the signal lights which are attached on to the jacket.

U.S. Pat. No. 5,370,566 to Kenneth C. Mitchell and Linda M. Mitchell, dated Dec. 6, 1994, "Lighted life Jacket" which discloses a lighted life jacket made as a flotation vest, which may be worn by a person to float when in water, for facilitating a location of a user wearing the life jacket. The lighted jacket includes a two light assembly in the front section and one light assembly in the back.

U.S. Pat. No. 3,621,501 to Jordan, Johnnie B., dated Oct. 21, 1969 "life preserver with flashing distress signal" discloses a U shaped or an equivalent buoyant collar equipped with signalling light, which flashes when the wearer enters the water.

Non of the above mentioned prior art consists of signal lights apparatus and horn apparatus that is secured on to the jacket which indicates the direction of turning, moving, slowing and stopping for riders of non-enclosed vehicles. Therefore, it is desirable to have the present invention, because the invention will assist to solve the present problem of non-enclosed vehicles moving on the road and public places without alerting and forewarning other vehicles, non enclosed vehicles and pedestrians. Further, this invention provides an extreme benefit to the user, that by owning one signal light jacket, may be used for all said activities.

SUMMARY OF THE INVENTION

The bicycles, roller blades, snow boards, skies, water skies etc., are popular outdoor activities for people today. There are several thousand people who use these non-enclosed vehicles for transportation, sports and various exercise purposes in normal weather conditions as well as in rain, snow etc. However, most of these said non-enclosed vehicles are not equipped with a proper signal light system to indicate the riders approach, direction of turning, slowing, stopping or moving.

The present invention is in the form of a strap jacket, attached with six signal lamp assemblies which comprise with signal light assemblies and among other devices directly connected to the switch panel assemblies, power source in battery assembly, wherein said assemblies are electrically communicated with each other to activate, and illuminate and flash in an intermittent manner, and illuminate and remain on, creating a visible signal to indicate the turning signal, moving signal, slowing signal and stopping signal, as well as the horn assembly for sound modulation for warning signal.

The main object of the present invention is to provide a signalling apparatus and horn apparatus for riders of non-enclosed vehicles, means bicycles, roller blades, skate boards, skies, jet skies, water skies, snowmobiles etc., to alert and forewarn other vehicles, other non-enclosed vehicles and pedestrians on the road and its' vicinity.

It is another object of this invention to provide a system operated in a systematic manner by a switching mechanism, that said signalling apparatus and horn apparatus alert and forewarn other vehicles, non-enclosed vehicles and pedestrians, indicating the riders' impending approach, changing of direction, moving, slowing and stopping, including sound modulation of the horn warning wherein other vehicles, non-enclosed vehicles and pedestrians on the road and its' vicinity take necessary precautions and proceed in a safe manner.

It is still a further object of the invention to provide a clear visibility of the signal lamps attached on the safety signal jacket, which is easily seen by other vehicles, other non-enclosed vehicles and pedestrians, who approach from all directions, so they may have sufficient time to take necessary safety precautions while they are moving.

It is a further object of the invention to provide a traffic guiding system for riders of non-enclosed vehicles, to communicate with each other by signalling, and indicating the direction where each rider is approaching, turning, moving, slowing and stopping, also with the sound modulation of the horn warning, which may help riders of non-enclosed vehicles to be alerted and take the necessary safety precautions. This may minimize the accidents that occur within riders, as well as other people in their vicinity.

It is a further object to provide reliable and relatively inexpensive devices attached on to the safety signal jacket, which may be worn directly over the wearers' cloths, that is easily adjusted by various strap members to create a tightly fitted or loosely fitted garment.

It is another object to provide a safety signal jacket which is wearable for various activities without changing any components of the said safety signal jacket.

It is another object to provide a safety signal jacket made out of waterproof webbing, preferably, made of nylon or other similar waterproof material, also waterproof signal lamp assemblies, light assemblies, horn assembly, switch assemblies, power source in battery assembly and among other devices, wherein the user may wear said safety signal jacket for various activities in water, snow as well as in any weather conditions.

It is another object to provide a safety signal jacket, wherein a rider may have the ability to carry a backpack or other similar sack without concealing any signal lamps, allowing said lamps to be visible to others.

To achieve the above objects, the present invention provides a garment-shaped strap jacket member attached with electrically communicated signal lamp assemblies, light assemblies, switch panel assemblies, power source in battery assemblies, among other devices for signalling, preferably the illumination mechanism controlled by the switching mechanism which is connected to the power source in battery mechanism. In accordance with the invention, thereon, provided is a strap jacket made of waterproof webbing comprising of a shoulder panel member worn around the neck extending from the left shoulder arm to the right shoulder arm and a waistband member that connects to the said shoulder panel member by four shoulder strap members, which is positioned on the back left and right and front left and right of the wearers' body, and side strap members, and chest strap members attached to said shoulder strap members forming a secure and comfortable jacket. The said jacket also incorporates six signal lamp assemblies, means the signalling lamp, each comprising of three indicating colour light zones, the amber colour, red colour and white colour, and light assembly, means one or sequences of lights to illuminate and flash in an intermittent manner or illuminating and remain on, as normally seen in the rear of automobiles, and other among devices, means devices needed for said lights to be activated for illuminating and flashing in an intermittent manner or illuminating and remain on, including the coloured cover lens which represents the above mentioned colour zones.

The signal lamp assemblies performs in the following manner, (a) illuminating and flashing the light assembly in an intermittent manner in the amber colour zone for turning signal, (b) illuminating and flashing the light assembly in an intermittent manner both amber and red colour zones for slowing signal, (c) illuminates brighter, the light assemblies in both white and red colour zones without flashing for stopping signal, (d) illuminating and flashing light assemblies in an intermittent manner in the red colour zone for moving signal. It is important to note that the present invention is to provide a method, for replacing a blue cover lens over the white cover lens, especially for skiers or snowmobile riders riding in bad weather conditions, when the white light is not clearly visible.

The two arm signal lamp assemblies are affixed to the arm strap members located on the left and right shoulder panel member that both said lamps are positioned on the upper part of the wearers' arms as illustrated in FIG. 5. The other four signal lamp assemblies, two are secured to the back left and right shoulder strap members, and the other two front signal lamp assemblies are secured to the front left and right supplementary shoulder strap members, which are placed over the long section of the front shoulder strap members, wherein one end of said supplementary shoulder strap is affixed to the long shoulder strap member and the other end is secured by a "Velcro" element to the shoulder panel member, whereby said supplementary shoulder strap members will have flexibility to be unfastened and fastened from said shoulder panel member, if necessary. This is to protect said front signal lamp assemblies being concealed form the "backpack" straps when a rider needs to carry a "backpack" and wears the "backpack" straps over the front shoulder arm, as illustrated in FIG. 13. The back signal lamp assemblies are fitted to the upper part of the back left and right shoulder strap members, whereby the said lamp assemblies are able to swivel and move towards the arm of the user as shown in dotted lines next to the back signal lamps in FIG. 14. This also is mainly to provide sufficient backspace for the rider to carry a "backpack" or similar bag without shielding the back signal lamp assemblies.

Further, the safety signal jacket member, incorporates two switch panel assemblies means switches, weirs and other among devices which is directly connected to pushbutton switches activate and control said signal light each comprising with three pushbutton switches mounted on the switch panel, that is affixed to the front left and right shoulder strap members, which connects to the said light assemblies in the signal lamp assembly, which is controlled by a switch panel assembly to activate, illuminate and flash in an intermittent manner, or activate, illuminate and remain on, of said signal light assemblies. Further included is a power source in battery assembly and plurality of weirs directly connected to all light assemblies, switch panel assemblies, power source in battery assembly and among other devices that electrically communicates and allows said light assemblies to activate, illuminate and flash in an intermittent manner or illuminate and remain on.

Each said light assembly is controlled by a pushbutton switch which is attached on to the switch panel assembly. The left switch panel assembly controls the light assembly in the amber colour zone, red colour zone and white colour zone for left turn signal, slowing signal and stopping signal respectively. The right switch panel assembly controls the light assemblies in the amber colour zone for right turn signal, red colour zone for moving signal as well as to activate the horn assembly.

The pushbutton switches in the switch panel assemblies operate in the following manner, (a) the pushbutton switch assigned for left turn signal mounted on the left switch panel assembly when depressed, will illuminate and flash the light assembly in the amber colour zone in the left lamp assemblies located on the left arm, left front and left back indicating left turn signal. (b) The pushbutton switch assigned for right turn signal located at the right switch panel assembly when depressed, will illuminate and flash in an intermittent manner, the light assemblies in the amber colour zone on the right arm, on the right front, on the right back indicating the right turn signal. (c) The pushbutton switch assigned for slowing signal is located at the left switch panel assembly when depressed, the light assemblies in the amber colour zone and red colour zone on all sides are illuminated and flash indicating the rider is preparing to slowdown or slowing. (d) the push button switch assigned for the stop signal is located at the left switch panel assembly when depressed, the light assemblies in the red colour zone and white colour zone in all sides will illuminate brighter, and remain on, without flashing to indicate the rider is at a complete stop. (e) The pushbutton switch assigned for the moving signal located at the right switch panel assembly when depressed, all light assemblies in amber colour zone, white colour zone and red colour zone are automatically shut off, and is switched on to the flashing mode illuminating in an intermittent manner the light assembly in the red colour zone indicating the rider is in a moving position. This will help riders who forget to switch off the amber lights for turning, white light and red light for stopping while the rider is in a moving position.

The horn assembly is mounted in front of the waistband member, which is connected to the horn switch assembly and to the horn pushbutton switch, mounted on the right switch panel assembly at the front right shoulder strap member. The horn assembly and horn pushbutton switch are connected to the power source in the battery assembly by plurality of weirs for electrical communication. The right pushbutton switch, assigned for the horn assembly when depressed, activates the sound modulation in the horn assembly indicating the warning signal.

Further, the invention provides an ON-OFF switch assembly at the back of the waistband member where the power source in battery assembly is located, when said switch is in the OFF position, all electrical communication will deactivate and shut off said signal light assemblies, said switch panel assemblies, said horn assembly, and among all other devises, when the jacket is not in use. When said switch is in the ON position all electrical communication is activated in all said assemblies when rider needs to use said safety signal jacket.

Further features and advantages of the invention will be apparent from the detailed description herein below set forth, together with the accompanying drawings.

DESCRIPTION OF THE PREFERRED EMBODIMENT

Figure 1:
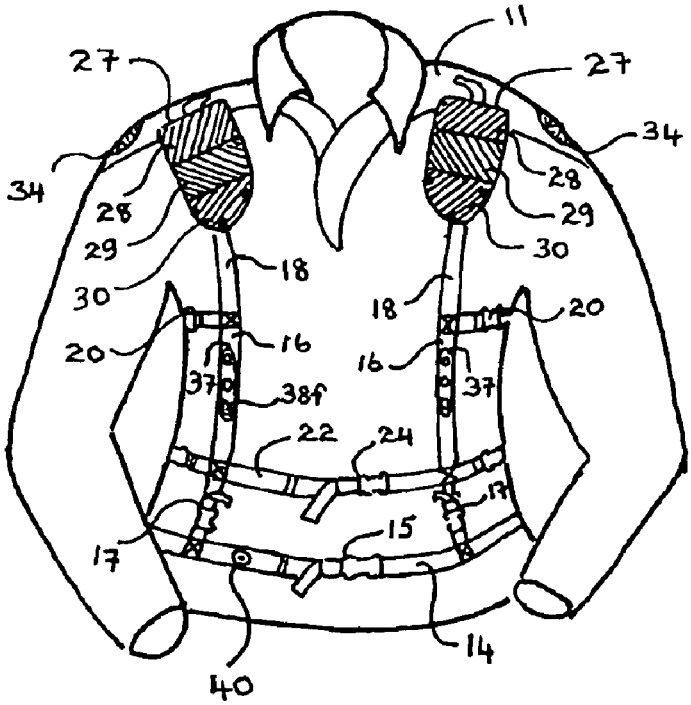
FIG. 1 is a front view showing a present invention directly worn over the shirt.
Figure 2:
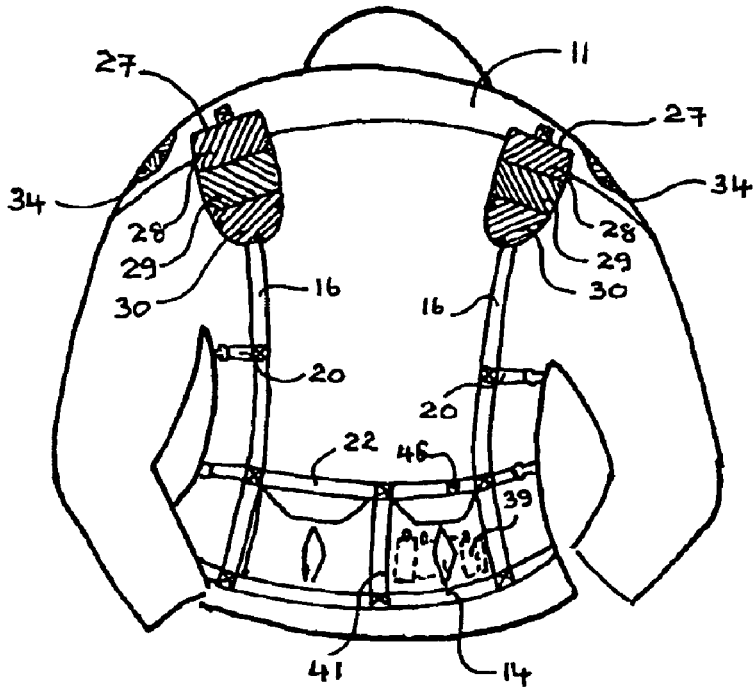
FIG. 2 is a back view of the invention worn over the shirt.
Figure 5:
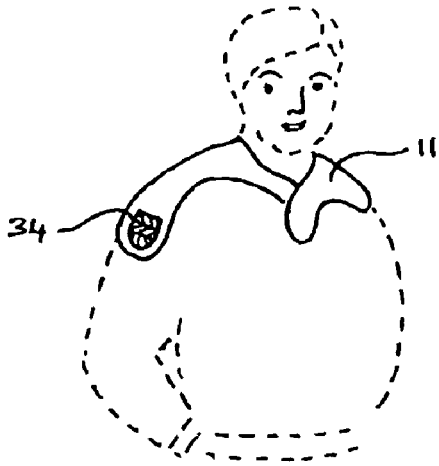
FIG. 5 is a view of a front and one of the shoulder panel member worn by a user, taken along line 5—5, of FIG. 1.
Figure 6:
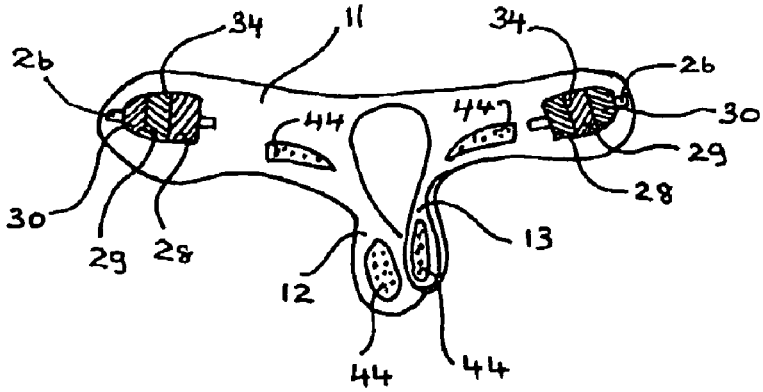
FIG. 6 is a shoulder panel member of the safety signal jacket taken along line 6—6, of FIG. 1.
Figure 7:
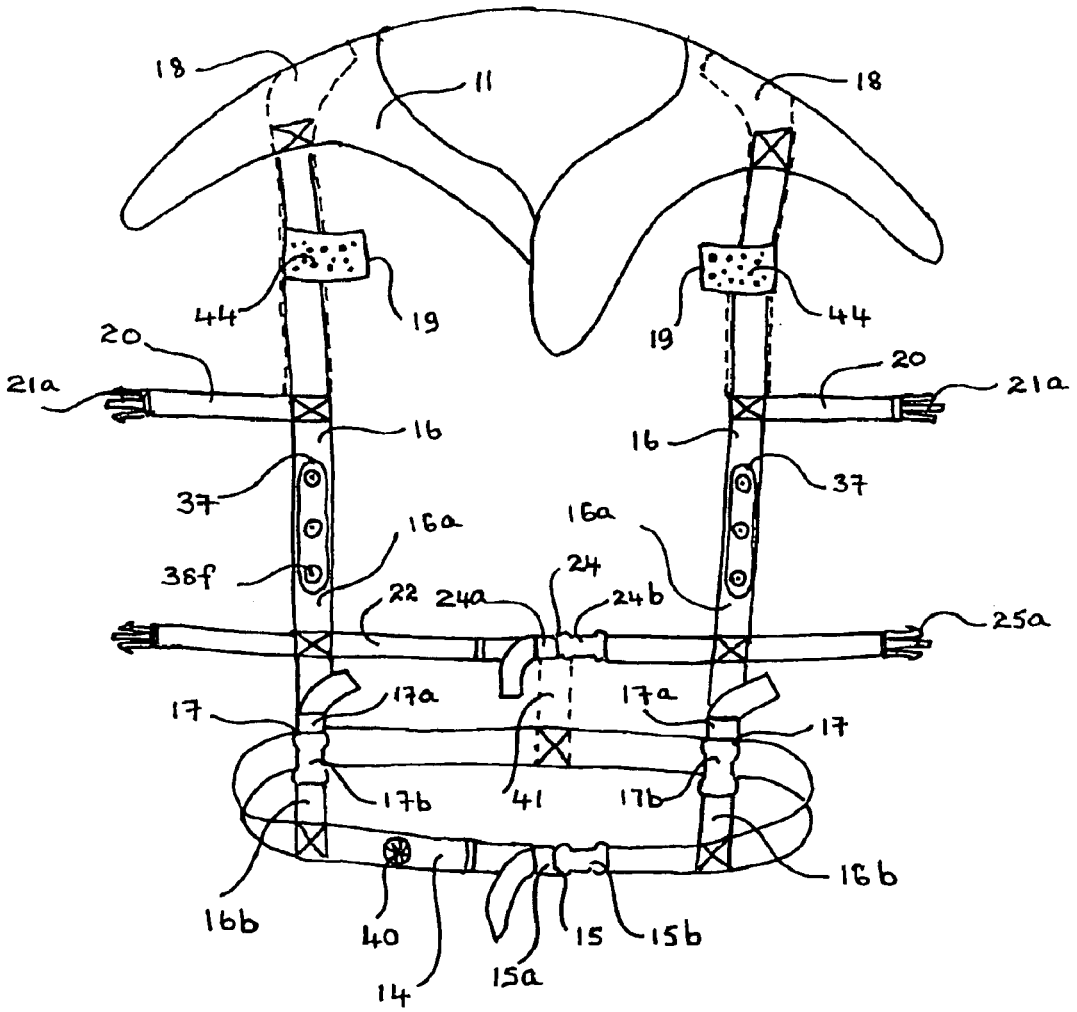
FIG. 7 is a front view, on an enlarged scale, taken along line 7—7 of FIG. 1.
Figure 8:
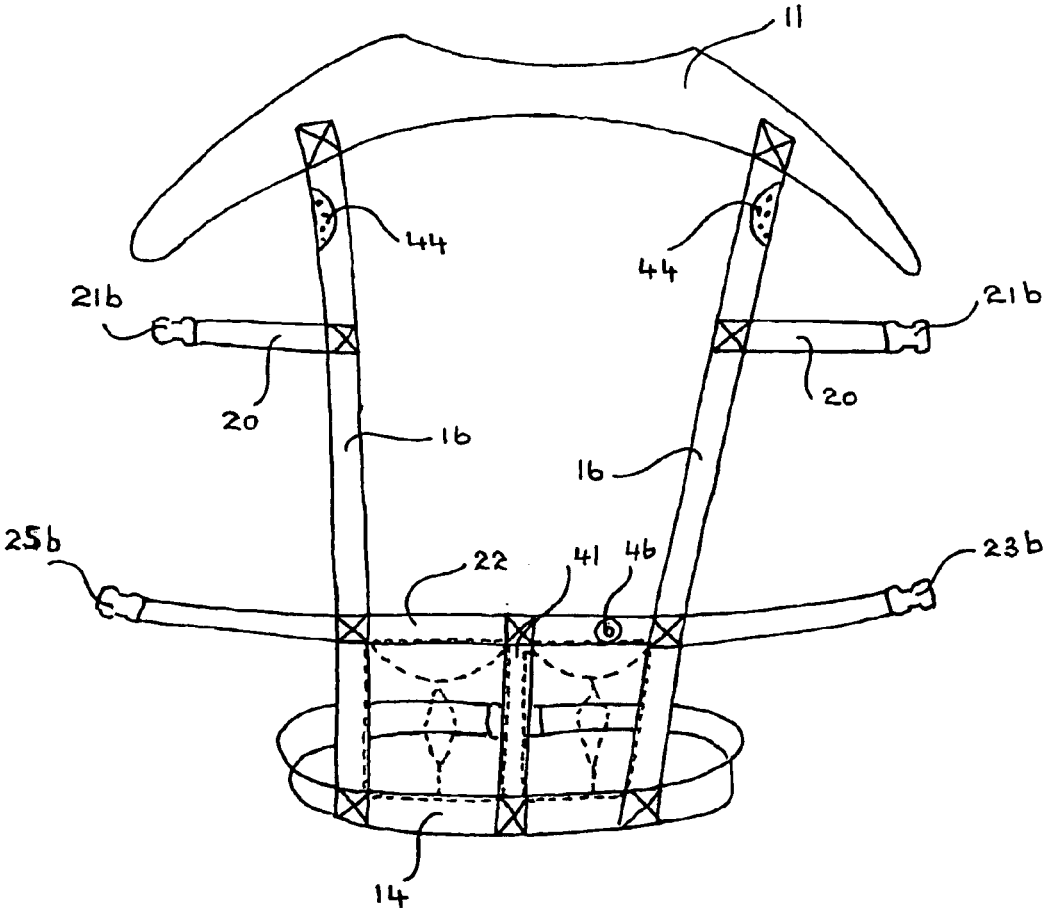
FIG. 8 is a back view, on an enlarged scale, taken along line 8—8 of FIG. 1.

In particular to the drawing FIGS. 1 through 15, that illustrates the safety signal jacket member generally designed by the reference numeral 10. Reference is now made to FIG. 1, the front view of the safety signal jacket, and FIG. 2 is the back view of the safety signal jacket, wherein illustrates the present invention member 10 worn directly over the normal shirt, which includes a shoulder panel member 11, means a wide comfortable shoulder panel, which extends from left shoulder arm to the right shoulder arm, worn around the neck as illustrated in FIG. 5, and adapted with a split front section secured together overlapping out side flap 13 onto flap 12 by a "Velcro" element 44 as shown in FIG. 6, and a waistband member 14, means the webbing strap, as shown in FIGS. 7 and 8, which is attached to the opposite side of the shoulder panel member 11 by four shoulder strap members 16, wherein said safety signal jacket is securely worn by the user. As illustrated in FIG. 7, the waistband member 14 that sits around the waist, to be fastened and adjusted by a quick release type buckle member 15, thereof, one end of said waistband member 14 is attached to one segment of the buckle 15*a* and the other end of said waistband member is attached to the receptacle segment 15*b* of said buckle, whereby both segments fasten together by inserting one segment into the other.

Reference is now to FIGS. 7 and 8 which illustrates the large image of the front and back view of the safety signal jacket member 10, which comprises of four shoulder strap members 16, two of said strap members 16 are positioned at the front left and right, and the other two said shoulder strap members are positioned at the back left and right of said safety signal jacket member 10. As illustrated in FIG. 7, each of the front said shoulder strap members 16 extends from front left and front right of said shoulder panel member 11, over the chest of the wearer, down to the front portion of the waistband member 14. Further, each of said front strap members 16 separates into two sections, a long section 16*a* and short section 16*b*, wherein both said sections are connected and adjusted together by a quick-release plastic type buckle member 17, or other similar type quick-releasable buckle. The upper end of each longer section of left and right front shoulder strap members 16*a* is permanently affixed means stitched or other similar method, to the left and right of the front shoulder panel member 11 respectively, and lower end of each said shoulder strap 16*a* is attached to one fragment 17*a* of the buckle 17. The shorter shoulder strap 16*b*, one end is permanently affixed to the waistband member 14 by stitching or other similar method, and upper end of said shorter shoulder strap 16*b* is attached to the receptacle member 17*b* of the buckle member 17, wherein both sections 16*a* and 16*b* shoulder strap members connect together by the use of buckle 17.

Figure 3:
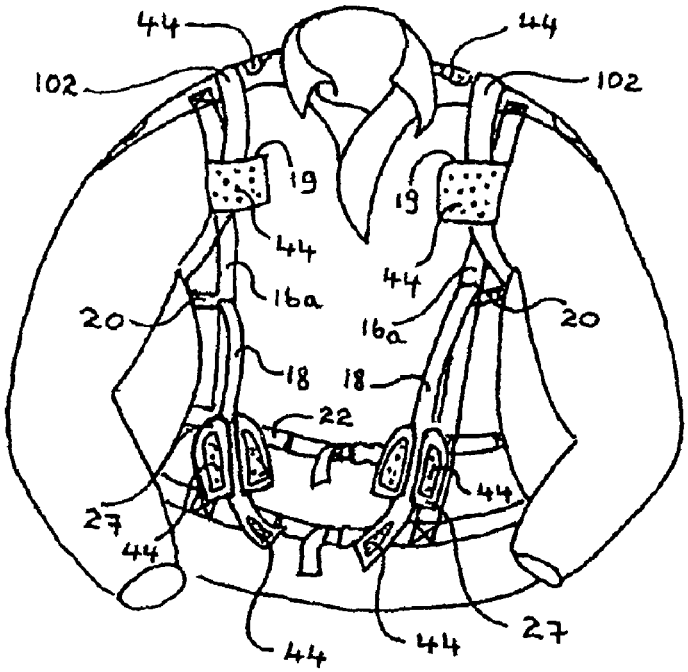
FIG. 3 is a front view of the invention, showing supplementary shoulder strap member unfastened from shoulder panel member, taken along line 3—3 of FIG. 1.
Figure 15:
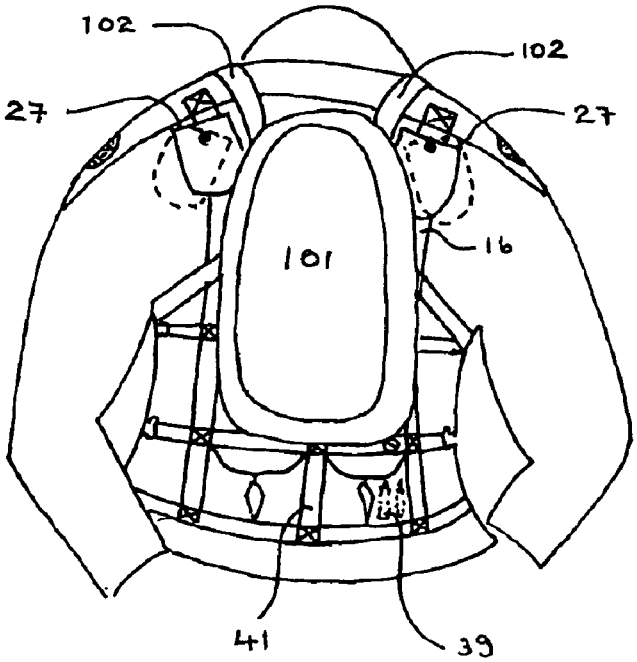
FIG. 15 is a perspective view of a back section, showing user carrying a backpack without swivelling back signal lamp assemblies.

As shown in FIG. 3, upper part of the front left and right shoulder strap members 16*a* is overlapped by the supplementary strap members 18, thereof lower end of each said supplementary strap member 18 is permanently affixed to the shoulder strap 16*a*, at the point where the side strap member 20 is located, and the other end is fastened to the shoulder panel member 11 by a "Velcro" element 44, wherein said supplementary strap member 18 has the ability to be fastened and unfastened from the shoulder panel member 11 when a rider needs to carry a "backpack" As illustrated in FIG. 3, further, provided are couple of flap members 19 comprising of Velcro element 44, wherein one end is affixed to the front shoulder panel 16*a* and the other end freely allowing means, said flap has a free end whereby enabling said flap to open from the free end allowing to position the "backpack" strap 102 over the shoulder strap member 16*a*, and close said flap member 19 over the "backpack" strap 102 as shown in FIG. 3, and fasten the supplementary shoulder strap 18 over the flap member 19 to the shoulder panel member 11 as illustrated in FIG. 1. The flap member 19 comprises with a "Velcro" element 44, that secures to the other "Velcro" element that is affixed to the back of the front signal lamp assembly 27. This method will prevent the front signal lamp from being concealed by "backpack" straps 102. FIGS. 2 and 8 illustrates the back left and right shoulder strap members 16, both extend from left and right of the back shoulder panel member 11 down to the back portion of the waistband member 14 of the safety signal jacket member 10. As illustrated one end of each said back shoulder strap member 16 is affixed to the shoulder panel member 11, and the other end affixed to the waistband member 14, so that both back shoulder straps 16 will be positioned closer to the arm of the wearer, wherein there will be sufficient space available between left and right back shoulder strap members 16, for a rider to carry a "backpack" 101 or similar bag on the back without concealing the back signal lamp assemblies 27, as illustrated in FIG. 15. This will be described in more detail in section under the title "Carrying a Backpack"

Figure 4:
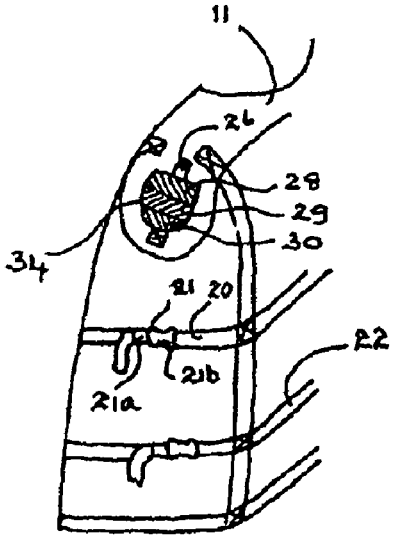
FIG. 4 is a side view of the invention with some parts shown, taken along line 4—4, of FIG. 1.

In order for the shoulder strap members 16 to remain in place without shifting, and also said straps to be firmly secured to each other in a proper manner, as illustrated in FIG. 4, pair of side strap members 20 are provided to both left and right sides of the safety signal jacket member 10. As illustrated in FIGS. 7 and 8, each of said side strap members 20 have two sections, the front section and back section, wherein one end of the front section is affixed to the front shoulder strap member 16 and the other end is attached to one segment 21*a* of buckle member 21. As illustrated in FIG. 8, one end of the back section of said side strap members 20 is attached to the back shoulder strap members 16, and the other end is attached to the receptacle segment 21*b* of the buckle member 21, where by, left front and left back, right front and right back of said sections are connected to each other by the use of buckle 21 as illustrated in FIG. 4.

As illustrated in FIGS. 1, 7 and 8, further provided is, chest strap member 22 around the safety signal jacket member 10, below the side strap member 20, comprising of three sections, two front left and right sections, and one back section, including buckle members 23, 24 and 25. As illustrated in FIG. 7, the front left section is permanently attached to the front left shoulder strap member 16*a*, whereby one end of the said section is attached to one segment of the buckle member 25*a*, and the other end is attached to receptacle segment of the buckle member 24*b*. The front right section of said front chest strap member 22 is permanently attached to the right shoulder strap member 16*a*, having one end attached to one segment of buckle member 23*a* and the other end is attached to one segment of the buckle member 24*a*. As illustrated in FIG. 8, the back section of the chest strap member 22 is permanently affixed to the back left and back right shoulder strap member 16, and one end of said back chest strap member 22 is attached to the receptacle segment 25*b*, and the other end to the receptacle segment 23*b*, wherein all said sections of said chest strap member 22 are connected to each other by inserting and fastening each segment of the buckle member 23*a* to 23*b*, and 25*a* to 25*b*, and 24*a* to 24*b* respectively.

As illustrated in FIG. 6, pair of arm strap members 26 is provided at both left and right of the shoulder panel member to hold the signal lamp assemblies 34, whereby said signal lamp assemblies are inserted through said arm strap members 26.

All strap members 16,18,20,22,26 and flaps 19, including shoulder panel member 11 and waistband member 14, are made of waterproof nylon or other similar webbing materials, which may be employed for that purpose and to be protected from any type of weather conditions. The strap members are connected together by stitching, buckling, using "Velcro" or other similar method for the purpose of flexibility of the safety signal light jacket member 10, which allows the said safety signal jacket member 10 to be worn as a close fit or loose fit to the wearers' body. For example; some riders, especially who are more in to sports, prefer to ware the sport outfits which fit to the body, in which case the user can adjust all said straps until the said jacket is firmly fitted to the body. Others who prefer to ware it over loose and baggy cloths may loosen the straps accordingly.

Figure 11:
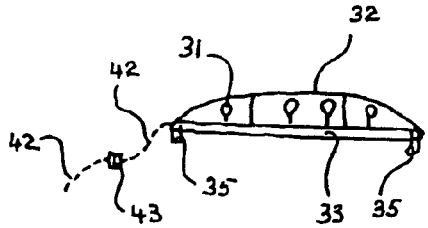
FIG. 11 is a side view of the large scale of signal lamp assembly showing signal light assemblies, taken along line 11—11 of FIG. 1.

As illustrated in FIGS. 1 and 2 each of said front left and front right supplementary shoulder strap members 18, and back left and back right shoulder strap members 16 comprises with signal lamp assemblies 27, means said signal lamp assemblies are divided into three colour zones, amber colour zone 28, red colour zone 29 and white colour zone 30, and as shown in FIG. 11, includes the battery powered light assembly 31 means the light bulb or sequences of bulbs which produce light beams, and other among devices means any devisers needed for said light assemblies to be activated, illuminated and flash in an intermittent manner and illuminate and remain on. Further, as illustrated in FIG. 11, included are holders and wires 42 for electrical communication, and coloured cover lens 32, and the base member 33 to hold all said assemblies. In addition, two signal lamp assemblies 34 are secured to the arm strap members 26 on the shoulder panel member 11, at a convenient position on both left and right side of the shoulder arms of the safety signal jacket member 10 as illustrated in FIGS. 5 and 6, wherein said signal lamp assemblies 34 are clearly visible to other vehicles, non-enclosed vehicles or pedestrians approaching from either side of the rider. Further said signal lamp assembly 34 is separated into three colour zones amber colour zone 28, red colour zone 29, white colour zone 30, same as the signal lamp assembly 27. As illustrated in FIGS. 1,2 and 6, in numerals 28,29 and 30, wherein each said signal lamp assemblies 27 and 34 are represented by colour zone means (a) amber colour zone 28 for the turn left/right, slowing signal. (b) red colour zone 29 for moving, also used for slowing and stopping signal. (c) white colour zone 30 for stopping signal. The operating system will be explained in detail later in this section.

Figure 9:
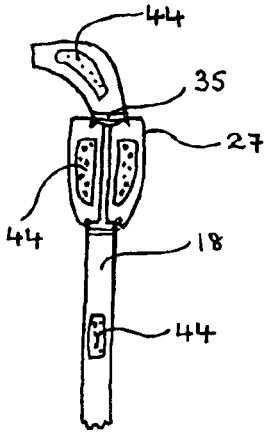
FIG. 9 is a perspective view of the back of signal lamp member, taken along line 9—9 of FIG. 3.
Figure 12:
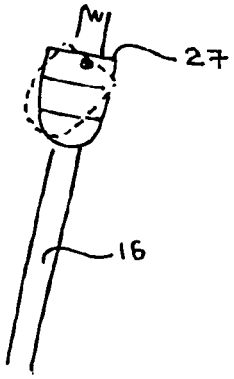
FIG. 12 is a view of back signal lamp assembly, illustrated with dotted line said lamp assembly has a capability of swivelling, taken along 12—12 of FIG. 2.
Figure 14:
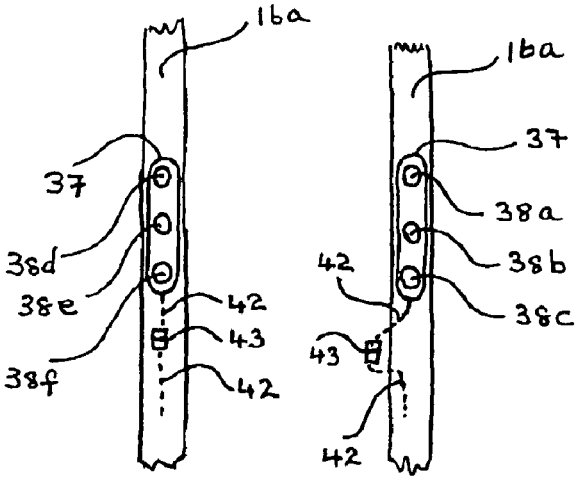
FIG. 14 is a view of switch panel assemblies showing pushbutton switches, taken along 14—14 of FIG. 7.

All said signal lamp assemblies 27,34 are made with moulded plastic or similar hard material. Further, base member 33 provides support to hold the light assembly 31 and other among devices including light sockets and electrical wires. As illustrated in FIG. 9 the back section of said front lamp assemblies 27, comprises with two open ends, providing sufficient space for supplementary strap member 18 to be inserted through, and also provided are clip members 35, at the top and the bottom, back face of the base member 33 for the purpose of securing said lamp assembly 27 to the supplementary shoulder panel 18, further, comprises of a narrow opening which runs through the middle of said base member 33, allowing said signal lamp assembly 27 to be completely removed from the supplementary shoulder strap member 18 for the purpose of replacing a new signal lamp assembly if necessary, and also provided is the "Velcro" element 44 on both sides of the narrow opening to secure said supplementary shoulder strap member 18 to the flap member 19 on the shoulder strap member 16*a*. As illustrated in FIG. 12, the back shoulder signal lamp assembly 27 has a different base member 33, which consists of an attachment at one point, wherein said signal lamp assemblies 27 are movable towards the arm of the rider when a rider needs to carry a "backpack" 101 as illustrated in FIGS. 12 and 15. The back of said lamp assemblies 27 also comprises of a "Velcro" element 44, which secures with the other "Velcro" element 44 at the back shoulder strap member 16 as shown in FIG. 8. As illustrated in FIGS. 11 and 14 further, provided the electrical junction box 43 which has male and female segments known in prior art, wherein one segment is connected to the wires 42 which runs through the safety signal jacket to said lamp assemblies and to said switch assemblies, other segment is connected to the wires 42 coming from the said signal lamp assemblies and said switch assemblies. This will help to remove said signal lamp assembly and switch assembly from said safety jacket member, if user needs to replace new signal lamp assembly or switch assembly if necessary.

Figure 10:
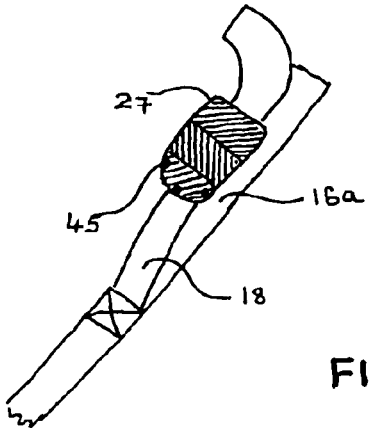
FIG. 10 is a perspective view of the front of the signal lamp member, taken line 10—10 of FIG. 1.

As illustrated in FIG. 11 the cover lens member 32, of said signal lamp assemblies 27, 34 are preferably made from translucent or transparent coloured plastic or similar material normally seen in automobile taillights. Further, provided is an additional blue coloured cover lens for the purpose of changing the white colour zone into blue colour zone, when the white light is not clearly visible, particularly for skiers or snowmobile riders riding in bad weather conditions. To secure firmly said blue colour lens over white colour lens, and for enabling said cover to be removed or inserted, further provided are three lateral protuberance 45 around the ridge of the signal lamp assembly, where the white light cover lens is located, as illustrated in FIG. 10.

As illustrated in FIG. 14, two switch panel assemblies 37, each comprising with three pushbutton switches attached to the front left and right shoulder strap member 16*a*. The switch panel assemblies 37, means electrically connected switch assembly which is operated by pushbutton switches 38*a*, 38*b*, 38*c*, 38*d*, and 38*e* to control said signal light assembly 31 to electrically communicate and activate, illuminate and flash in an intermittent manner or illuminate and remain on, and also to control the electrical power to said light assemblies 31 in said signal lamp 27 and 34. These switch panel assemblies 37 are mounted on a plastic base or similar hard material and affixed to left and right shoulder strap member 16*a* by stitching, gluing or other similar method as shown in FIG. 7. The light assemblies 31 are directly controlled by said switch panel assemblies 37, which connects to a power source in battery assembly 39, means battery and among other devices, which supply electrical power to the light assembly 31, horn assembly 40, switch panel assemblies 31, horn pushbutton switch 38*f* or any other devices which need electrical communication to operate, means to activate said switch panel assemblies 37 and light assemblies 31, and said other devices, and supplying electrical power to said switch panel assemblies and said light assemblies, and said other devices to simultaneously respond to the electrical power and provide flow of electricity to said switch panel assemblies 37 and to said light assemblies 31, and to other devises, for selectively controlling the said light assemblies 31 to illuminate and flash in an intermittent manner or illuminate and remain on, and also to the horn assembly 40 and to the horn pushbutton switch 38*f* for sound modulation of said horn assembly. As seen in FIGS. 1 and 7, the horn assembly 40 means sound modulation normally well known in the art, located at the front right side of the waistband member 14, which is electrically communicated to the horn switch assembly 41*f* to activate the sound of said horn assembly 40. Further, for the flow of electricity to each of said assemblies, provided are plurality of wires 42 that run throughout the signal strap jacket member 10, which is electrically connected to electrically communicate at the appropriate locations of each said left and right switch panel assemblies 37, light assemblies 31, horn assembly 40, power source in battery assembly 39 and to other devices that needs to be operated by the flow of electrical current.

As illustrated in FIG. 14, the left switch panel assembly 37 is operated by three pushbutton switches, pushbutton switch 38*a* for the left signal, pushbutton switch 38*b* for the slowing signal, pushbutton switch 38*c* for the stopping signal. The right switch panel assembly 37 is also operated by three pushbutton switches, pushbutton switch 38*d* for the right signal, and pushbutton switch 38*e* for moving signal, and pushbutton switch 38*f* for sound modulation for the horn signal. All said pushbutton switch assemblies are operated in the following manner.

First, the rider needs to illuminate only the light assemblies 31 in the left amber colour zone 28, to indicate that the rider is preparing to turn left and turning left, the rider may depress the pushbutton switch 38*a* of the left switch panel assembly 37. This will illuminate and flash in an intermittent manner light assemblies 31 located in the amber colour zone 28 in the left front, back and side signal lamp assemblies 27 and 34.

Second, the pushbutton switch 38*d* of the right switch panel assembly 37 when depressed, will activate said right light assemblies 31 in the amber colour zone 28, which are located at the right front, back and side arm signal lamp assemblies 27 and 34, illuminating and flashing in an intermittent manner indicating that the rider is preparing to turn right and turning right.

Third, the pushbutton switch 38*b* of the left switch panel assembly 37, when depressed, will activate all red light assemblies 31 located in the red colour zone 29 and the amber colour zone 28 on all said left and right lamp assemblies 27 and 34 illuminating and flashing in an intermittent manner indicating that the rider is preparing to slowdown and slowing.

Fourth, the pushbutton switch 38*c* of the left switch panel assembly 37, when depressed, will activate light assemblies 31, in white colour zone 30 and red colour zone 29, in all said left and right signal lamp assemblies 27 and 34 illuminating and remain on brighter, indicating that the rider is in the stop position. Further, pushbutton switch 38*c* is electrically connected to each other signal light assembly 31, whereby shuts off the light assembly 31 in the amber colour zones 28, and also shuts off the flashing mode light assembly in the red colour zones 29. For example; when rider is in the stop position, only the light assembly in the white colour zones and red colour zones will illuminate and remain on without flashing.

Fifth, the pushbutton switch 38*e*, when depressed, will activate the light assemblies 31 located on all left and right red colour zones 29 in the lamp assemblies 27,34 illuminating and flashing in an intermittent manner, indicating that the rider is in the moving position. Further, said switch 38*e* is connected and electrically communicated to the light assembly 31 in the amber colour zones 28, white colour zones 30, and red colour zones 29, that when the rider depresses said pushbutton switch 38*e*, all signal light assemblies 31 located in colour zones 28,29,30 will shut off automatically, and will switch on to the flashing light mode in the red colour zone 29. Further, provided is a deviser, which makes a clicking sound (as normally seen in the automobiles when turn signal lights are on) when the turning signal, slowing signal and stopping signal lights are illuminated. This will help the rider to be alert and shut off the turning and stopping signal lights which may confuse other drivers and people in its vicinity when the rider is moving.

As illustrated in FIGS. 1 and 7, horn assembly 40 is located in the front right side of the waistband member 14, which is connected and electrically communicated with the horn switch assembly 38*f* located in the right switch panel assembly 37, and to the power source in battery assembly 39, through plurality of weirs 42 for receiving current. The pushbutton switch 38*f* when depressed the horn assembly 40 is electrically activated for the sound modulation of the horn assembly. The base of said horn assembly 40 is made of moulded plastic or other similar material and waterproof webbing that reduces the chances of water contacting the horn assembly.

As illustrated in FIGS. 2 and 8 said safety signal jacket member 10 comprises of an ON-OFF switch assembly 46 at the back of the waistband member where the power source in battery assembly is located, when said switch is in the OFF position, all electrical communication will deactivate and shut off said signal light assemblies, said switch panel assemblies, said horn assembly, and among all other devises, when the jacket is not in use. When said switch is in the ON position all electrical communication is activated in all said assemblies when rider needs to use said safety signal jacket.

As illustrated in FIGS. 2 and 8 said safety signal jacket 10 comprises of two pouches at the back of said jacket 10, between chest strap member 22 and the waistband member 14, affixed to the waistband member 14, and to the left shoulder strap member 16, chest strap member 22 and to the short strap member 41, The right pouch is affixed in the same manner as the left pouch at the opposite side as illustrated in FIGS. 2 and 8, and each pouch is divided into two compartments. The first compartment of the right pouch, holds the power source in battery assembly 39 which supplies power to the light assemblies 31, and to the horn assembly 40, and to the switch panel assemblies 37, and to other devices which needs electrical operation. The other compartment is to house the spare battery for power source in battery assembly 39. The right pouch also provides two compartments, which provides sufficient space to carry a cell phone, water bottle or any other necessary item for the riders' requirements.

Further the circuits, electronic chips, fuses and flashes are located within appropriate location and all bulbs are of the standard type used generally for this purpose.

"Carrying a Backpack", as seen in the FIG. 15, generally riders carry a backpack while riding non-enclosed vehicles. Most of said backpacks are made with front shoulder straps and various other straps, which provides support to the backpack and also secures the backpack comfortably to the body. However, if a rider needs to carry a backpack while wearing a safety signal jacket member 10, may cause a problem since the two front straps of the backpack may interfere and shield the front signal lamp assemblies on the safety signal jacket. To deal with the problem, the present invention provides a unique harness system as illustrated in FIG. 3. First, unfasten the supplementary shoulder strap member 18 from shoulder panel member 11, and wear the backpack 101 placing the front straps 102 of the backpack over the arm of the wearer. Secondly, place the flap member 19 over the backpack shoulder strap 102, and fasten and secure said supplementary strap member 18 to the shoulder panel 11 overlapping said backpack strap 102, securing to the shoulder panel member 11 as illustrated in FIG. 1.

Figure 13:
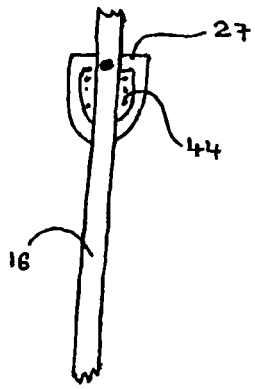
FIG. 13 is a view of back face section of the back signal lamp assembly.

As illustrated in FIG. 15, the back signal lamp assembly 27, is affixed in a different manner to overcome this problem, thereof said back signal lamps assembly 27 have flexibility to move the lamp assemblies 27 towards the arm of the wearer, when wearer needs to carry a backpack 101, and secure said lamp assemblies 27 onto the shoulder strap member 16 by the Velcro elements 44 which are provided on the back of said lamp assembly 27 and on the shoulder strap member 16 as illustrated in FIGS. 8,12 and 13.

The signal light jacket may be easily folded which fits into a pouch which may be carried easily by hand or secured around the waist. The power source in battery pouch member 39 can be easily opened and the battery removed from the said compartment. The lens cover 32 of the signal lamp assemblies 27 and 34 also may be removed for changing of bulbs etc.

It is to be understood that the invention is not limited to the description and drawings hereinabove, and various changes in shape, size and arrangements of parts as well as certain details of the illustrations may be carried out in other methods without departure from its sprit and scope of invention defined in the appended claim

What is claimed is:

1. A safety signal light Jacket for riders of non-enclosed vehicles comprising;

(a) the strap jacket consists with six signal lamps, each said signal lamp having three color zones, each of said color zone having at least one light source, representing at least one indicating signal light wherein each of said signal lamp is able to indicate the left turn signal, right turn signal, slowing signal, stopping signal, moving signal, and jogging mode signal, and (b) having a shoulder panel member worn around the neck, which extends across left shoulder arm to right shoulder arm, having a split front portion, secured together by an overlapping outside flap to an inside flap by hook and loop element, and (c) the waistband member around the waist comprises with a buckle member, having one end attached to one segment of the buckle and the other end attached to the receptacle segment of the buckle, wherein both segments inserted into each other connect the waistband together, and (d) the four shoulder strap members, of which two of said shoulder strap members are affixed at the front left and front right of said shoulder panel member, and the other two shoulder strap members are affixed at the back left and right of said shoulder panel member, and (e) the front left and front right shoulder strap members each having two sections, a longer section and shorter section which is connected by the buckle member, and (f) having two supplementary shoulder strap members, which overlaps part of longer section of each said shoulder strap member, and (g) a pair of side strap members each having two sections connected by buckle member, wherein each section is affixed to the front left and back left, and also front right and back right of the shoulder strap members, and (h) a chest strap member around the safety signal jacket, below the side strap members, which comprises of three sections, wherein two of said front sections are stitched to the front left and right shoulder strap members, and the back section is stitched to the back left and right shoulder strap members, connecting each section by three buckle members, and (i) a pair of arm strap members, which is attached to both left and right shoulder panel member, and (j) a pair of flap members, one end of each said flap member is stitched to the front shoulder strap member and the other end unattached keeping it free, enabling said flap to open from the free end allowing to position the "backpack" straps over the shoulder strap member, and (k) said six signal lamp assemblies of which two of said lamp assemblies secured to the left and right arm strap members located in the shoulder panel member, and two of said lamp assemblies secured to the front left and right supplementary shoulder strap members, and the other two are secured to the back left and right upper part of the shoulder strap members and (l) each of said signal lamp assembly having three color zones comprises with light assembly or assemblies which are able to produce the light beams, and the lamp circuit device for said light beam to activate illuminate and flash in an intermittent mode or illuminate and remain on without flashing mode, and (m) a horn assembly, and (n) the two switch panel assemblies affixed to the front left and right shoulder strap members, each switch panel having three pushbutton switches, and switch circuit device required to activate the pushbutton switches for control of the light assemblies, also the horn assembly, and (o) said signal light jacket provides a power source in the battery assembly for current to flow through the electrical wires which runs through said safety signal jacket to the said switch panel assemblies, to said light assemblies, to said horn assembly and to other required devices including lamp circuit, switch circuit master circuit which need electrical current for electrical communication between each other for said light assemblies to activate and illuminate and flash in an intermittent manner, and/or Steady ON mode.

(p) having translucent cover lenses secured to each of said lamp assemblies, and (q) having said safety signal jacket made with waterproof webbing material, waterproof sealing for lamp assemblies, said switch assemblies, master circuit, said horn assembly, said power source in battery assemblies and said other devices, and (r) having two pouches in the back of said safety signal jacket, between chest strap member and waistband member, each said pouch is divided into two compartments, one pouch to hold the power source in battery assembly and the master circuit and spare battery for emergency, other pouch for user to carry a cell phone, water bottle or any other items, and (s) an ON-OFF switch assembly located at the back of the waistband member wherein said switch is able to activate and deactivate the entire electronic system, thereof when the switch is set to OFF position deactivates and shuts off the electricity to all components of the signal jacket, and when the switch is set ON position activates all said components, and (t) said six signal lamp assemblies positioned on the upper section of the front left, front right, back left, back right, left shoulder arm and the right shoulder arm of the signal light jacket, wherein said signal lamps illuminate and respond to predetermine illuminating sequences, wherein said indicating signals are clearly visible from all directions, and (u) the signal light jacket comprises of an electronic operating signal light system which connects to the lamp circuits, switch circuits and to the master circuit, and (v) said signal lamps and light source connects to the master circuit device that comprises with a microprocessor which has a number of input and output lines, wherein the input lines are connected to the respective switch terminals and output lines are connected to the respective terminals of the light source, and (w) said input lines are connected and communicate with the switch assemblies wherein said switch assemblies send signals to the microprocessor in the master control devisor, wherein microprocessor is able to send preprogrammed light illuminating and flashing sequences to the light assemblies in the signal lamp through the output lines of the microprocessor, and (x) the horn assembly which is attached to the jacket, electrically connects to the output line of the microprocessor that operates by the respective switch assembly which connects to the input line of the microprocessor, and (y) all said light assemblies, signal lamp assemblies, switch assemblies, horn assembly, lamp circuit devisor, master circuit devisor and microprocessor and other respective electrical components are connected to the power source, and (z) the signal light system is able to run on two different types of batteries, nickel metal hydrate and regular alkaline battery power source, and the signal light system is powered with two voltages 4.8 V and 3.6 V for low voltage for the microcontroller to operate, at a higher voltage for maximum brightness of the light source.

2. A safety signal jacket in accordance with claim 1, wherein one end of said back shoulder strap members affixed to the shoulder panel member, and the other end is affixed to the waistband member by stitching, wherein said shoulder panel and waistband are held together.

3. A safety signal jacket in accordance with claim 1, wherein each of said front left and right shoulder strap members comprises of two sections, one long section and one short section, and one end of said long section is affixed to the shoulder panel member by stitching, and having the other end extend towards the waistband, which attaches to one segment of the buckle member, and the short section of said shoulder strap member having, one end stitched to the front said waistband member and other end attached to the opposite segment of said buckle member, whereby both segments of the buckles insert into each other connecting the long and short sections of said shoulder straps together.

4. A safety signal jacket in accordance with claim 3, wherein said long section of the shoulder strap member comprises with a supplementary shoulder strap member, whereby one end of said supplementary strap member is affixed to the long section of the shoulder strap member and the other end is secured to said shoulder panel member.

5. A safety signal jacket in accordance with claim 4, wherein said supplementary shoulder strap member is secured to the shoulder panel member, whereby said supplementary shoulder strap member enables to be fastened and unfastened from the shoulder panel member.

6. A safety signal jacket in accordance with claim 1, wherein two side straps members, each of said strap member having two sections connected by buckle member, and affixed by stitching to the left front and left back, right front and right back of shoulder strap members respectively, whereby said safety signal jacket can be adjusted as a tightly fitted garment or loosely fitted garment.

7. A safety signal jacket in accordance with claim 1, wherein further comprising of chest strap member, connecting each of said three sections by interlocking said three buckle members, whereby said safety signal jacket is adjustable as a fitted or loose garment to the wearers' body.

8. A safety signal jacket in accordance with claim 1, wherein six signal lamp assemblies secured to left and right back shoulder strap members, and to the front left and right supplementary shoulder strap members and to the left and right shoulder arm strap members.

9. A safety signal jacket in accordance with claim 8, wherein two arm signal lamps secured to the shoulder arm strap members located on the left and right of said shoulder panel member, by inserting said arm strap member through the split section of the said signal lamp base member, and securing said base to the shoulder panel member by Velcro elements.

10. A safety signal jacket in accordance with claim 8, wherein the two signal lamp assemblies secured to the upper end of the back left and right shoulder strap members by one point of attachment, so that said lamp assemblies have flexibility of swiveling towards the arm of the wearer and back.

11. A safety signal jacket in accordance with claim 10, wherein base of said signal lamps further secured to the shoulder strap member by hook and loop elements.

12. A safety signal jacket in accordance with claim 8, wherein the two signal lamp assemblies secured to each of the supplementary shoulder strap members.

13. A signal jacket in accordance with claim 12, wherein said signal lamp assemblies made with molded plastic base, and hook and loop element outer face base, whereby said signal lamp assemblies secured to the front shoulder strap members and the front flap members by hook and loop elements.

14. A signal jacket in accordance with claim 1, wherein two switch panel assemblies affixed to the front left and right shoulder strap members, each comprises of three pushbutton switches and other devices, whereby said each pushbutton switch assemblies are electrically communicated with power source in battery assembly, and said other devices including respective input lines of the microprocessor in the master circuit.

15. A signal jacket in accordance with claim 1, wherein each of said lamp assemblies further comprises of coloured plastic cover lenses representing amber colour, red colour and white colour, also have a system where the said lenses are able to change into different colors according to requirement of specific country's non enclosed vehicle's rules.

16. A signal jacket in accordance with claim 15, wherein includes a lateral protuberance around the ridge of the signal lamp assembly, where the white cover lens is located, for replacing a blue cover lens during bad weather conditions or any other use including country's non-enclosed vehicle rules.

17. A signal jacket in accordance with claim 8, wherein included are two clip members to the back of the base of the signal lamp for the purpose of securing said lamp assemblies to the strap members.

18. A signal jacket in accordance with claim 1, wherein includes electrical connectors at each of said signal lamp assemblies and switch panel assemblies, horn assembly, master circuit device and the power source, wherein said lamp assemblies, switch panel assemblies, horn assembly, master circuit assembly and power source assembly are able to be disconnected from the main electrical wires that runs through said safety signal jacket, for replacement of each component.

19. A signal jacket in accordance with claim 1, wherein each said signal lamp assemblies includes at least one light assembly on each of said colour zone, and other devices required to illuminate said light assemblies.

20. The system according to claim 1, lamp assembly consists with electronic circuit devices with required transistors and current limiting resistors to ensure that a minimum current flows through the LED lights, also controls said light source (LED) by surface mount transistors acting as switches.

21. The system according to claim 1, the microprocessor output lines are used as open collector outputs and are used to control transistors, which in turn controls the lights or the speaker in the horn assembly.

22. The system according to claim 1, microcontroller is programmed to run under crystal oscillator, and all timing has been calculated accordingly and programmed to change the control of the signals in predetermined sequences.

23. The system according to claim 22, the microprocessor receives a signal from timer control both the duration and frequency of flashing of the various light sources.

24. The system according to claim 1, wherein includes cable wires, connected between power source in battery assembly, switch assemblies, all signal lamp assemblies, master control and other components which need electrical energy.

25. The system according to claim 1, microprocessor receives signals from left turn signal switch and communicates with the selective input line of the microprocessor through the specific resistor, and processes said signal and sends to the yellow light located in the front left, back left, left shoulder arm lamp assemblies through the current control resistors and transistor, so that said LED lights illuminate and flash in an intermittent mode to indicate the left turn signal.

26. The system according to claim 1, microprocessor receives signals from right turn signal switch and communicates with the selective input line of the microprocessor through the specific resistor, and processes said signal and sends to the yellow light located in the front right, back right, right shoulder arm lamp assemblies through the current control resistors and transistor, so that said LED lights illuminate and flash in an intermittent mode to indicate right turn signal.

27. The system according to claim 1, microprocessor receives signals from slowing signal switch and communicates with the selective input line of the microprocessor through the specific resistor, and processes said signal and sends to the yellow lights and red lights located in the front right, front left, back left, back right, left shoulder arm, right shoulder arm lamp assemblies through the current control resistors and transistors, so that said LED lights illuminate and flash in an intermittent mode to indicate slowing signal.

28. The system according to claim 1, microprocessor receives signals from stopping signal switch and communicates with the selective input line of the microprocessor through the specific resistor, and processes said signal and sends to the lights in the red and white color zones located in the front right, front left, back left, back right, left shoulder arm, right shoulder arm lamp assemblies through the current control resistors and transistors, so that said LED lights illuminate and remain on without flashing mode to indicate stopping signal.

29. The system according to claim 1, microprocessor receives signals from moving signal switch and communicates with the selective input line of the microprocessor through the specific resistor, and processes said signal and sends to the lights in the red color zones located in the front right, front left, back left, back right, left shoulder arm, right shoulder arm lamp assemblies through the current control resistors and transistors, so that said LED lights illuminate and flash in an intermittent mode to indicate the moving signal.

30. The system according to claim 1, microprocessor receives signals from clicking sound mode signal switch and communicates with the selective input line of the microprocessor through specific resistor, and processes said signal and combines with the turn signal, slowing signal, stopping signals, so that when the turn signal, slowing signal and stopping signals activate, the clicking sound also to be activated at the same time.

31. The system according to claim 1, microprocessor receives signals from the horn switch and communicates with the selective input line of the microprocessor through specific resistor, and processes said signal and sends to the horn located in the front of the jacket, so that when the horn switch is activated the horn will make a sound.

32. The system according to the claim 1, microprocessor is also used to programme various flashing and steady mode sequences according to legal requirements of various countries.

* * * * *